US005787860A

United States Patent [19]

Geels et al.

[11] Patent Number: 5,787,860

[45] Date of Patent: Aug. 4, 1998

[54] VALVE WITH COMBINED VALVE MEMBERS AND FUEL—INJECTION SYSTEM PROVIDED WITH SUCH A VALVE

[75] Inventors: Pierre Y.W. Geels, Brussels; Michel Morenville, Ixelles Dinant, both of Belgium

[73] Assignee: U.S. Philips Corporation, New York, N.Y.

[21] Appl. No.: 800,249

[22] Filed: Feb. 13, 1997

[30] Foreign Application Priority Data

Feb. 14, 1996 [EP] European Pat. Off. ..... 96200363

[51] Int. Cl.[6] ..... F02M 3/00

[52] U.S. Cl. ..... 123/339.27; 137/625.39; 137/872; 251/211

[58] Field of Search ..... 251/210, 211; 137/625.39, 625.5, 872; 123/531, 585, 339.27

[56] References Cited

U.S. PATENT DOCUMENTS

| | | | |
|---|---|---|---|
| 5,184,773 | 2/1993 | Everingham | 137/625.5 |
| 5,190,076 | 3/1993 | Kloehn | 137/625.5 |
| 5,443,241 | 8/1995 | Odaira et al. | 137/625.5 |
| 5,497,746 | 3/1996 | Semence et al. | 123/339.27 |
| 5,549,136 | 8/1996 | Drocco et al. | 137/872 |
| 5,564,388 | 10/1996 | Meiwes et al. | 123/339.27 |
| 5,649,562 | 7/1997 | Sturman et al. | 137/625.5 |

OTHER PUBLICATIONS

SAE Technical Paper No. 920294 Entitled "Development Of Air–Assisted Injector System" By Kenichi Harada et al. Published At The SAE International Congress & Exposition Held In Detroit, USA, Feb. 24–28, 1992.

*Primary Examiner*—Erick R. Solis
*Attorney, Agent, or Firm*—Robert M. McDermott

[57] ABSTRACT

A valve comprises an inlet and two outlets. The flow to the two outlets is controlled by an integrated valve having two members which operate in conjunction with the two valve seats associated with the outlets. The valve is used in an air-assisted fuel-injection system of an internal-combustion engine, wherein the first outlet of the valve is connected to a bypass of a throttle valve of the engine, and the second outlet of the valve is connected to an air-assisted fuel injector of the fuel-injection system. In this manner, both the atomization of the fuel injected by the fuel injector and the idling speed of the engine are controlled by a single valve.

8 Claims, 3 Drawing Sheets

VALVE WITH COMBINED VALVE MEMBERS AND FUEL— INJECTION SYSTEM PROVIDED WITH SUCH A VALVE

BACKGROUND OF THE INVENTION

1. Field of the Invention

The invention relates to a valve comprising an inlet, a first outlet, a second outlet, a first valve member which cooperates with a valve seat of the first outlet, and a second valve member which cooperates with a valve seat of the second outlet, the first valve member and the second valve member being provided on a common driving shaft which is displaceable by an electric actuator.

The invention further relates to a fuel-injection system for an internal-combustion engine, which system comprises at least one air-assisted fuel injector, a fuel-supply system for supplying fuel to the fuel injector, said air-supply system comprising a valve having an inlet for connection to an air inlet of the engine in a location upstream of a throttle valve of the engine, a first outlet for connection to said air inlet in a location downstream of said throttle valve, and a second outlet for connection to the fuel injector.

2. Discussion of the Related Art

A valve and a fuel-injection system of the kinds mentioned in the opening paragraphs are known from SAE Technical Paper No. 920294 entitled "Development of Air-Assisted Injector System" by Kenichi Harada et al. published at the SAE International Congress & Exposition which was held in Detroit, USA, Feb. 24–28, 1992. The air-assisted fuel injector of the known fuel-injection system is suitable for installation in an intake manifold of an internal-combustion engine and atomizes the fuel supplied to the fuel injector by causing the air supplied to the fuel injector to collide and mix with the fuel. It is achieved in this way, that the atomization of the fuel supplied to the fuel injector is improved, so that the air-fuel mixture in the combustion chamber of the engine is homogenized. Furthermore, it is achieved that the spray direction of the fuel injector is improved, so that wall wetting of the intake manifold is reduced. In this way a higher response, lower emissions, and a better fuel economy of the internal-combustion engine are realized.

The known valve of the known fuel-injection system is used to regulate both an idling speed of the engine and the atomization of the fuel supplied to the fuel injector. For this purpose, the valve divides an air flow which is taken from the air inlet of the engine in a location upstream of the throttle valve of the engine via the inlet of the valve into an air flow which is conducted to said air inlet in a location downstream of said throttle valve via the first outlet of the valve and an air flow which is conducted to the fuel injector via the second outlet of the valve. A value of said air flow to the air inlet and a value of said air flow to the fuel injector are determined by a shape of the first valve member and the it second valve member of the valve, a shape of the valve seats of the first and second outlets of the valve, and a position of the first and second valve members relative to the valve seats of the first and second outlets of the valve. The values of said air flows are regulated through a displacement of the common driving shaft of the first and second valve members by means of the electric actuator of the valve which is controlled by a regulator of the internal-combustion engine as a function of, for example, an engine temperature. By regulating the value of the air flow through the first outlet of the valve, said regulator regulates the idling speed of the engine, and by regulating the value of the air flow through the second outlet of the valve, said regulator regulates the atomization of the fuel which is supplied to the fuel injector.

In the known valve of the known fuel-injection system, the first valve member and the second valve member are provided on the common driving shaft at a mutual axial distance. Between the first valve member and the second valve member, a bearing is provided for supporting the common driving shaft in radial directions. In this way vibrations of the driving shaft which occur under the influence of engine vibrations and which lead to wear of the valve members and the valve seats of the valve are reduced. A disadvantage of the known valve is that said bearing between the first valve member and the second valve member leads to a relatively large dimension of the valve in a direction parallel to the common driving shaft and to a relatively complicated structure of the valve.

SUMMARY OF THE INVENTION

It is an object of the invention to provide a valve of the kind mentioned in the opening paragraph which has a relatively small dimension in a direction parallel to the common driving shaft and a relatively simple construction, and which is proof against external vibrations.

According to the invention, the valve is for this object characterized in that the first valve member and the second valve member are combined into a single integrated valve member which is provided as such on the driving shaft and cooperates with both the valve seat of the first outlet and the valve seat of the second outlet. The integrated valve member extends both through a flow opening in the valve seat of the first outlet and through a flow opening in the valve seat of the second outlet, a first part of the integrated valve member constituting the first valve member and cooperating with the valve seat of the first outlet, and a second part of the integrated valve member constituting the second valve member and cooperating with the valve seat of the second outlet. By disposing the valve seat of the first outlet and the valve seat of the second outlet at a relatively small mutual distance, it is achieved that the integrated valve member has a relatively small dimension parallel to the driving shaft, so that the valve also has a relatively small dimension parallel to the driving shaft. By combining the first valve member and the second valve member into said single integrated valve member, it is further achieved that the valve has a relatively simple structure. Since the integrated valve member has a relatively small dimension parallel to the driving shaft, the driving shaft has a relatively small axial length, so that the driving shaft has a relatively high mechanical rigidity and vibrations of the driving shaft and the integrated valve member are limited. A bearing for supporting the driving shaft near the integrated valve member can thus be dispensed with, so that the simplicity of the valve is further enhanced.

A particular embodiment of a valve according to the invention is characterized in that the inlet has a cross-section with a first dimension perpendicular to the driving shaft which is great relative to a second dimension of said cross-section parallel to the driving shaft. The inlet of the valve merges into a distributing chamber which is bounded by the valve seats of the first and second outlets. Said second dimension of the cross-section of the inlet is limited as a result of the relatively small distance between the valve seat of the first outlet and the valve seat of the second outlet. Since said first dimension of the cross-section of the inlet is great relative to said second dimension of the cross-section, the cross-section of the inlet has an elongate shape allowing a sufficiently large air flow through the inlet of the valve in spite of the limited second dimension of the cross-section of the inlet.

A further embodiment of a valve according to the invention is characterized in that the second outlet comprises a flow restriction which is provided downstream of the valve seat of the second outlet. It is achieved through the use of said flow restriction, that a maximum air flow through the second outlet of the valve is small relative to a maximum air flow through the first outlet of the valve if the dimensions of the valve seat of the first outlet and the dimensions of the valve seat of the second outlet have comparable values. Since the accuracies with which the air flows through the first and second outlets can be regulated are determined by the accuracies of the shapes of the valve seats and the integrated valve member cooperating with the valve seats, the accuracy with which the relatively small air flow through the second outlet can be regulated and the accuracy with which the relatively large air flow through the first outlet can be regulated have comparable values if the first valve member of the integrated valve member and the second valve member of the integrated valve member are manufactured with comparable accuracies. The simplicity of the integrated valve member and the valve is further enhanced thereby.

According to the invention, a fuel-injection system of the kind mentioned in the opening paragraph is characterized in that the valve applied therein is a valve according to the invention. Providing the fuel-injection system with a valve according to the invention limits, the space which is necessary to mount the fuel-injection system in an internal-combustion engine. Furthermore, the operation of the fuel-injection system is not adversely affected by vibrations of the internal-combustion engine.

BRIEF DESCRIPTION OF THE DRAWINGS

The invention will be explained in more detail below with reference to the drawing, in which FIG. 1 diagrammatically shows an internal-combustion engine provided with a fuel-injection system according to the invention.

DETAILED DESCRIPTION OF THE PREFERRED EMBODIMENT OF THE INVENTION

Figure 1:
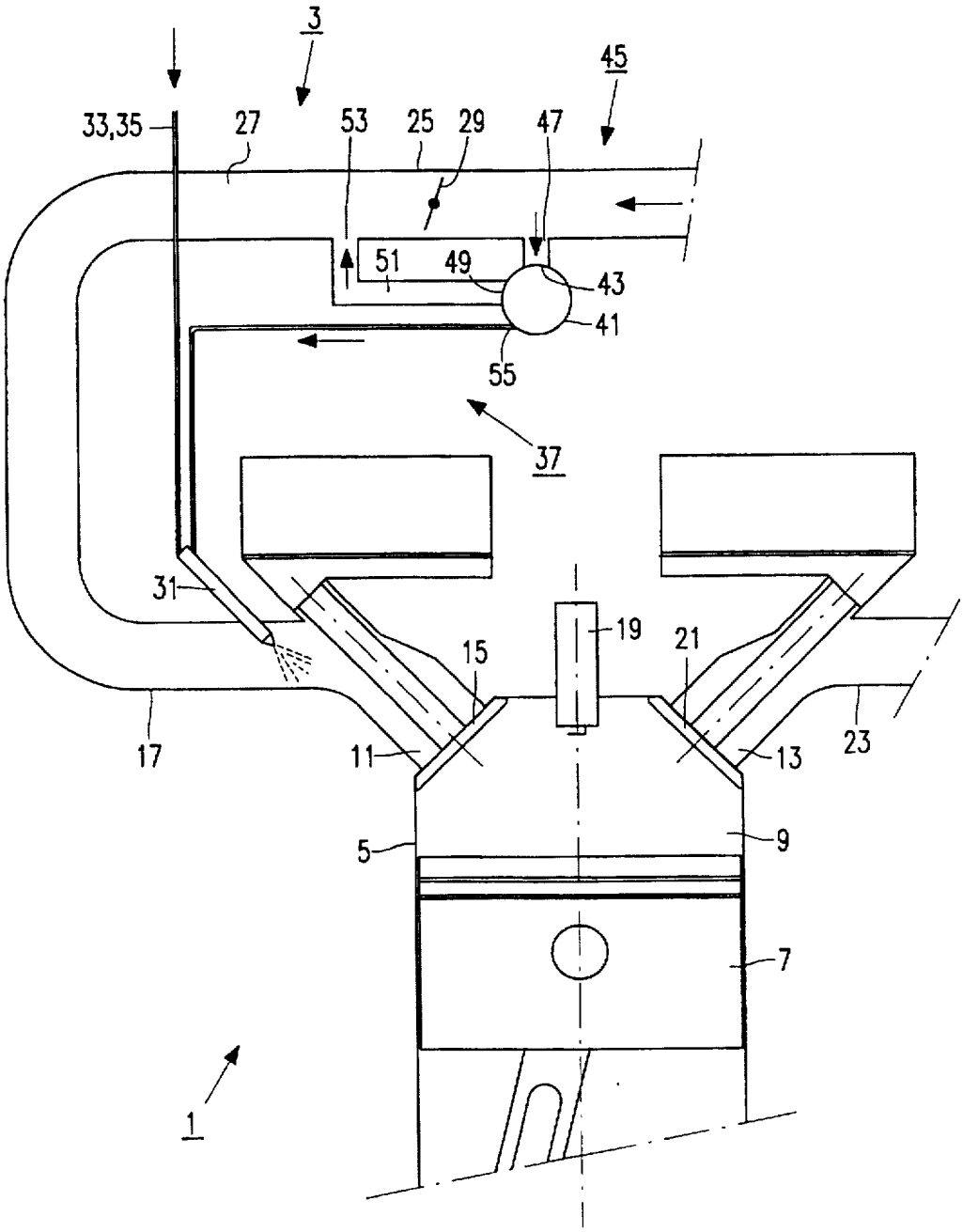

FIG. 1 diagrammatically shows an internal-combustion engine 1 which is provided with a fuel-injection system 3 in accordance with the invention. The engine 1 comprises at least one cylinder 5 in which a piston 7 is reciprocable. The cylinder 5 comprises a combustion chamber 9 with an inlet opening 11 and an outlet opening 13. The engine 1 further comprises a reciprocable inlet valve 15 for periodically admitting an air-fuel mixture from an intake manifold 17 into the combustion chamber 9, a spark plug 19 for periodically igniting the air-fuel mixture in the combustion chamber 9, and a reciprocable outlet valve 21 for periodically emitting spent gases from the combustion chamber 9 into an exhaust manifold 23. The intake manifold 17 is connected to a throttle-valve housing 25 of the engine 1 which comprises a channel 27 in which a throttle valve 29 is pivotable for controlling an air flow through the intake manifold 17 to the combustion chamber 9.

As FIG. 1 further shows, the fuel-injection system 3 of the internal-combustion engine 1 comprises a fuel injector 31 which is installed in the intake manifold 17 near the inlet valve 15 for injecting fuel into the air flowing through the intake manifold 17. The fuel-injection system 3 further comprises a fuel-supply system 33 which is not shown in detail in FIG. 1 and comprises a fuel-supply channel 35 for supplying fuel to the fuel injector 31. The fuel injector 31 is a so-called air-assisted fuel injector which is known per se from, for example, SAE Technical Paper No. 920294 entitled "Development of Air-Assisted Injector System" by Kenichi Harada et al. published at the SAE International Congress & Exposition which was held in Detroit, USA, Feb. 24–28, 1992. The fuel-injection system 3 further comprises an air-supply system 37 with an air-supply channel 39 for supplying air to the fuel injector 31. The fuel injector 31 atomizes the fuel supplied to the fuel injector 31 via the fuel-supply channel 35 by causing the air supplied to the fuel injector 31 via the airsupply channel 39 to collide and mix with the fuel. The atomization of the fuel leads to a homogeneous air-fuel mixture in the intake manifold 17 and an improved spray direction of the fuel injector 31, reducing wall wetting of the intake manifold 17. As a result, hydrocarbon emissions of the internal-combustion engine 1 are reduced, and a better fuel economy of the internal-combustion engine 1 is realized.

Figure 2:
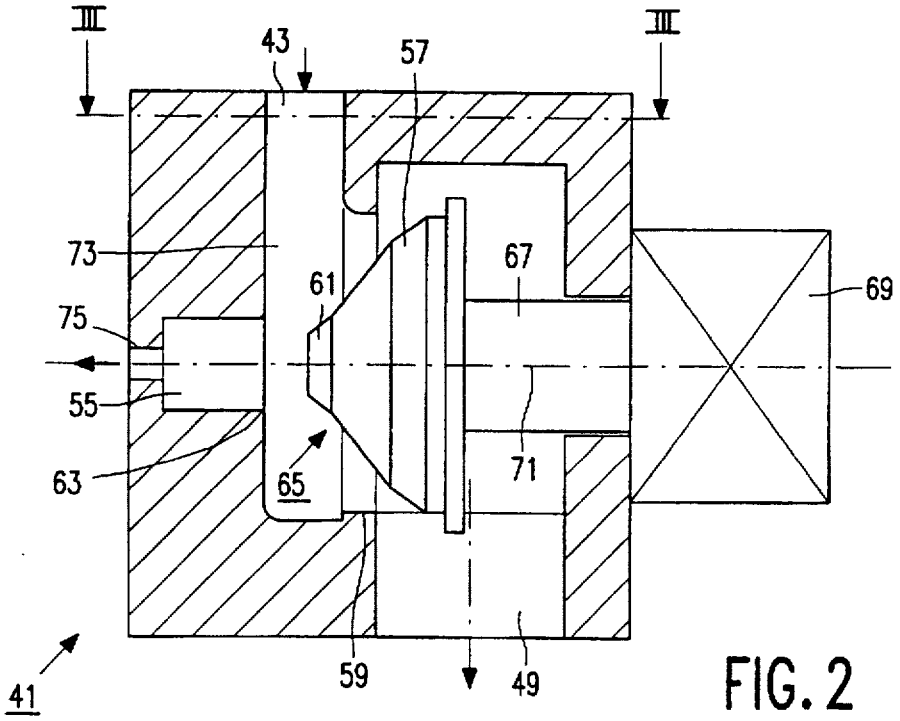
FIG. 2 shows a cross-section of a valve according to the invention which is used in the fuel-injection system of FIG. 1.

The air-supply system 37 further comprises a valve 41 in accordance with the invention which is shown diagrammatically only in FIG. 1. As FIG. 1 and FIG. 2 show, the valve 41 comprises an inlet 43 which is connected to an air inlet 45 of the internal-combustion engine 1 in a location 47 upstream of the throttle-valve 29. Furthermore, the valve 41 comprises a first outlet 49 which is connected via a bypass 51 to the air inlet 45 of the engine 1 in a location 53 downstream of the throttle-valve 29, and a second outlet 55 which is connected to the air-supply channel 39 of the fuel-injection system 3. The valve 41 is used to regulate both an idling speed of the engine 1 and the atomization of the fuel supplied to the fuel injector 31. The idling speed of the engine 1, which obtains when the throttle-valve 29 is in a position closing the channel 27 of the throttle-valve housing 25, is regulated in that an air flow through the bypass 51 is controlled by means of the valve 41, while the atomization of the fuel, i.e. the size of the fuel particles in the air-fuel mixture injected into the intake manifold 17 by the fuel injector 31, is regulated in that an air flow through the air-supply channel 39 is controlled by means of the valve 41. The valve 41 is controlled by an electric regulator of the internal-combustion engine 1, which is not shown in the figures, as a function of, for example, an engine temperature. Said electric regulator is, for example, a motor-management system which also controls the ignition moment of the airfuel mixture in the combustion chamber 9 and the amount of fuel injected by the fuel injector 31.

As FIG. 2 shows, the valve 41 comprises a first valve member 57 which cooperates with a valve seat 59 of the first outlet 49 of the valve 41, and a second valve member 61 which cooperates with a valve seat 63 of the second outlet 55 of the valve 41. The first valve member 57 and the second valve member 61 are combined into a single integrated valve member 65 of the valve 41, so that the first valve member 57 constitutes a first part of the integrated valve member 65 cooperating with the valve seat 59 of the first outlet 49, and the second valve member 61 constitutes a second part of the integrated valve member 65 cooperating with the valve seat 63 of the second outlet 55. The integrated valve member 65 is provided on a driving shaft 67 of the valve 41 which is a common driving shaft for the first valve member 57 and the second valve member 61 and is displaceable by an electric actuator 69 in an axial direction coinciding with an axis 71 of the driving shaft 67. The electric actuator 69 is a known and usual actuator such as, for example, a stepping motor and is controlled by the electric regulator of the engine 1 mentioned before.

Figure 4:
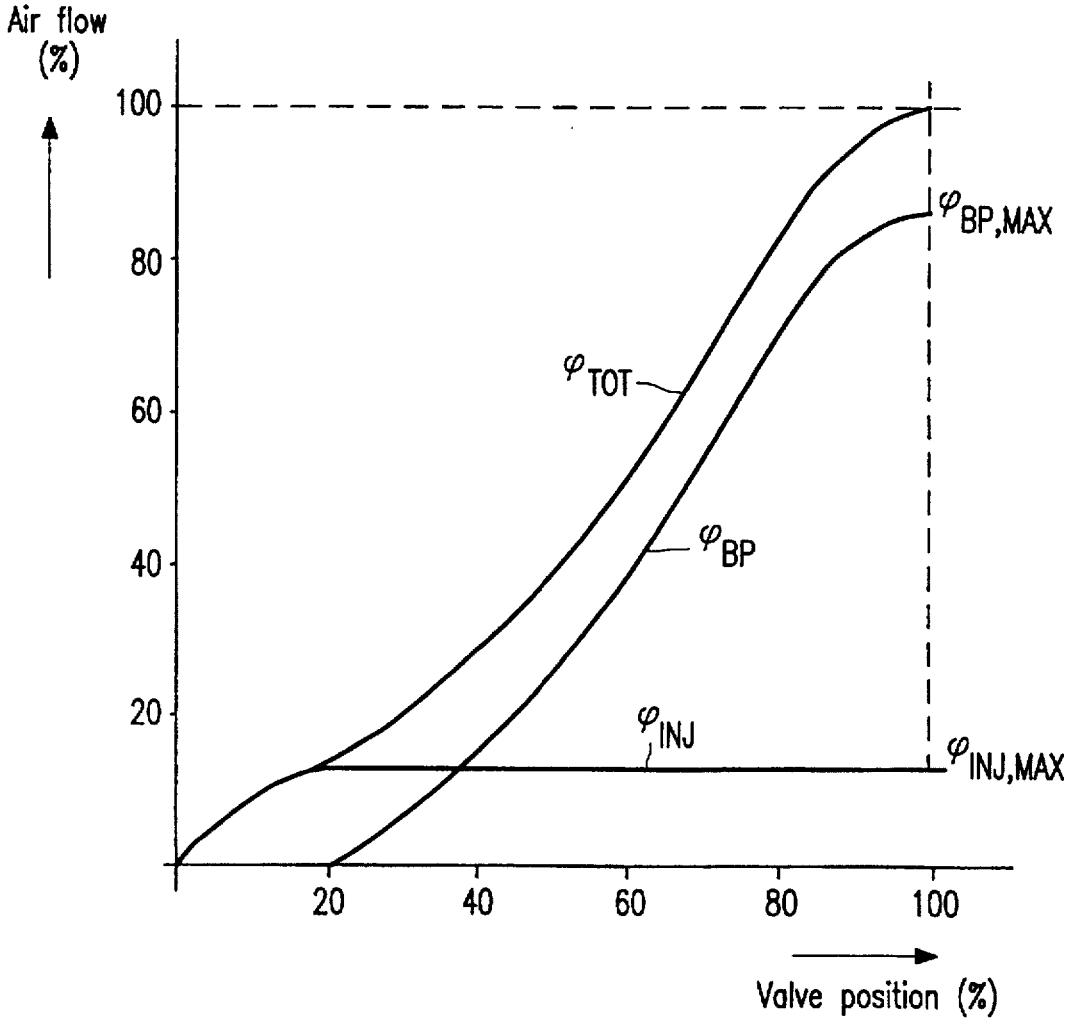
FIG. 4 shows an air-flow characteristic of the valve of FIG. 2.

The valve 41 divides the air flow taken from the air inlet 45 at the position 47 upstream of the throttle-valve 29 into the air flow through the bypass 51 and the air flow through the air-supply channel 39 of the fuel-injection system 3. A value $\phi_{BP}$ of the air flow through the bypass 51 and a value $\phi_{INJ}$ of the air flow through the air-supply channel 39 are determined by a shape of the first and second valve members 57 and 61 of the integrated valve member 65, a shape of the valve seats 59 and 63, and a position of the integrated valve member 65 relative to the valve seats 59, 63. In FIG. 4, an example is shown for the values $\phi_{BP}$ and $\phi_{INJ}$ and for a total air flow $\phi_{TOT}=\phi_{BP}+\phi_{INJ}$ as a function of the position of the integrated valve member 65, said values and said position being shown as a percentage of a maximum total air flow and a maximum position, respectively.

Since the first and second valve members 57 and 61 are combined into the single integrated valve member 65 which cooperates with both valve seats 59, 63 of the valve 41, a simple and compact structure of the valve 41 is achieved wherein the valve seats 59 and 63 are disposed at a relatively small mutual distance seen in a direction parallel to the axis 71 of the driving shaft 67, as shown in FIG. 2, which distance corresponds to a dimension of the integrated valve member 65 parallel to the axis 71. Since the integrated valve member 65 has a relatively small dimension parallel to the axis 71, the driving shaft 67 has a relatively small axial length and, accordingly, a relatively high mechanical stiffness. In this manner vibrations of the driving shaft 67 and the integrated valve member 65 which occur as a result of external vibrations exerted on the valve 41 by the internal-combustion engine 1 during operation and which lead to wear of the integrated valve member 65 and the valve seats 59 and 63 are limited as much as possible.

Figure 3:
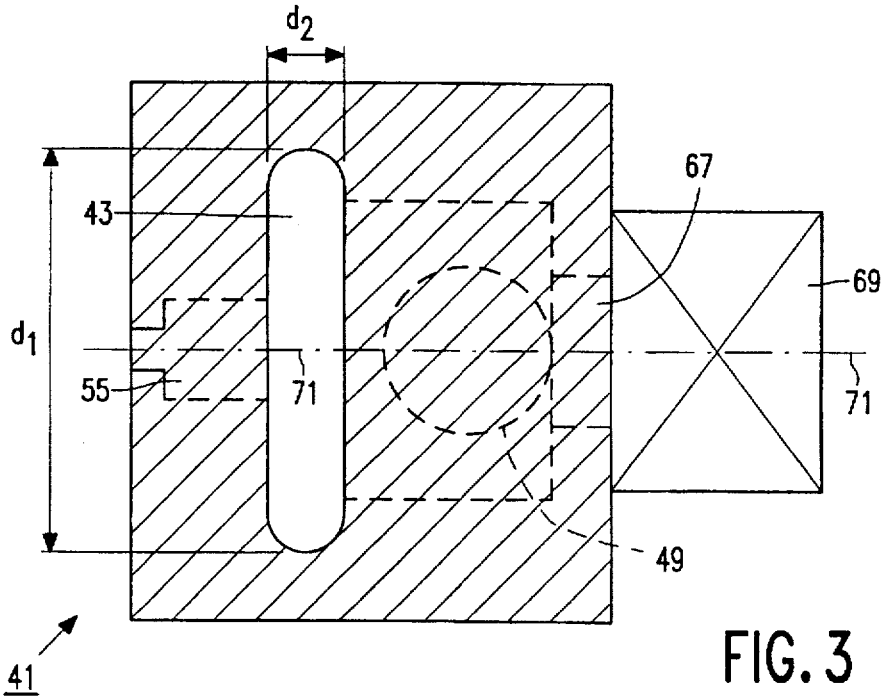
FIG. 3 shows a cross-section of the valve of FIG. 2 taken on the line III—III in FIG. 2.

As shown in FIG. 2, the inlet 43 of the valve 41 merges into a distributing chamber 73 which is bounded by the valve seats 59 and 63 of the first and second outlets 49 and 55 of the valve 41. Since the valve seats 59, 63 are disposed at a relatively small mutual distance parallel to the axis 71, the distributing chamber 73 and the inlet 43 also have a relatively small dimension parallel to the axis 71 limited by the presence of the valve seats 59, 63. As shown in FIG. 3, the inlet 43 of the valve 41 has a cross-section with an elongate shape, a first dimension $d_1$, of said cross-section perpendicular to the axis 71 being great relative to a second dimension $d_2$ of said cross-section parallel to the axis 71. Since said first dimension of said cross-section is great relative to said second dimension of said cross-section, the cross-section of the inlet 43 has an area which is sufficiently large for allowing a desired maximum total air flow through the inlet 43 in spite of the limited second dimension of said cross-section.

As FIG. 2 further shows, the second outlet 55 of the valve 41 comprises a flow restriction 75 which is provided in a location downstream of the valve seat 63 of the second outlet 55. As shown in FIG. 4, a maximum value $\phi_{BP,MAX}$ of the air flow through the first outlet 49 of the valve 41 is high relative to a maximum value $\phi_{INJ,MAX}$ through the second outlet 55 of the valve 41. It is achieved through the use of the restriction 75 in the second outlet 55, that the air flow through the second outlet 55 is restricted. This reduces a difference between an area of a maximum flow opening in the valve seat 59 of the first outlet 49 and an area of a maximum flow opening in the valve seat 63 of the second outlet 55 necessary to achieve said different maximum values of the air flows through the first and second outlets 49, 55, so that said maximum flow openings in the valve seats 59, 63 have diameters of a comparable order of magnitude. Therefore, also the first valve member 57 and the second valve member 61 of the integrated valve member 65 have diameters of a comparable order of magnitude. An accuracy with which the air flows through the first and second outlets 49, 55 can be regulated is determined by an accuracy with which the valve seats 59, 63 and the first and second valve members 57, 61 of the integrated valve member 65 are manufactured. Since the first and second valve members 57, 61 of the integrated valve member 65 have diameters of a comparable order of magnitude, the first and second valve members 57, 61 can be manufactured with comparable accuracies if the air flows through the first and second outlets 49, 55 are to be regulated with comparable accuracies. The integrated valve member 65 can be manufactured in a relatively simple manner as a result.

The valve 41 comprises two outlets 49 and 55. It is noted that the invention also relates to valves which comprise more than two outlets such as, for example, three outlets. In such a case, the valve members of the valve which cooperate with the valve seats of the three outlets are combined into a single integrated valve member which cooperates with the valve seats of the three outlets, each of the valve members constituting a different part of the integrated valve member.

It is further noted that the valve 41 can also be used without the flow restriction 75 in the second outlet 55, for example if the maximum air flows through the first and second outlets 49 and 55 have comparable values.

It is finally noted that the valve 41 according to the invention can also be used to regulate liquid flows instead of air or gas flows. Generally, the valve 41 according to the invention can be used in various kinds of pneumatic or hydraulic systems or devices such as, for example, hydraulic or pneumatic positioning devices.

I claim:

1. A valve comprising:

an inlet, a first outlet, a second outlet, a first valve member which cooperates with a valve seat of the first outlet, and a second valve member which cooperates with a valve seat of the second outlet;

the first valve member and the second valve member being provided on a common driving shaft which is displaceable by an electric actuator, characterized in that the first valve member and the second valve member are combined into a single integrated valve member which is provided as such on the driving shaft and cooperates with both the valve seat of the first outlet and the valve seat of the second outlet.

2. A valve as claimed in claim 1, characterized in that the inlet has a cross-section with a first dimension perpendicular to the driving shaft which is greater than a second dimension of said cross-section parallel to the driving shaft.

3. A valve as claimed in claim 1, characterized in that the second outlet comprises a flow restriction which is provided downstream of the valve seat of the second outlet.

4. A valve as claimed in claim 2, characterized in that the second outlet comprises a flow restriction which is provided downstream of the valve seat of the second outlet.

5. A fuel-injection system for an internal-combustion engine, which system comprises:

at least one air-assisted fuel injector, a fuel-supply system for supplying fuel to the fuel injector, and an air-supply system for supplying air to the fuel injector;

said air-supply system comprising:

a valve having an inlet for connection to an air inlet of the engine in a location upstream of a throttle valve of the engine, a first outlet for connection to said air inlet in a location downstream of said throttle valve, and a second outlet for connection to the fuel injector;

said valve comprising:

an inlet, a first outlet, a second outlet, a first valve member which cooperates with a valve seat of the first outlet, and a second valve member which cooperates with a valve seat of the second outlet, the first valve member and the second valve member being provided on a common driving shaft which is displaceable by an electric actuator, wherein the first valve member and the second valve member are combined into a single integrated valve member which is provided as such on the driving shaft and cooperates with both the valve seat of the first outlet and the valve seat of the second outlet.

6. A fuel injection system as claimed in claim 5, characterized in that the inlet has a cross-section with a first dimension perpendicular to the driving shaft which is first dimension perpendicular to the driving shaft which is greater than a second dimension of said cross-section parallel to the driving shaft.

7. A fuel injection system as claimed in claim 6, characterized in that the second outlet comprises a flow restriction which is provided downstream of the valve seat of the second outlet.

8. A fuel injection system as claimed in claim 5, characterized in that the second outlet comprises a flow restriction which is provided downstream of the valve seat of the second outlet.

* * * * *